United States Patent [19]

Baxter et al.

[11] Patent Number: 4,708,887

[45] Date of Patent: Nov. 24, 1987

[54] METHOD FOR COLORING POLYMER-INSULATED WIRE

[75] Inventors: Gordon D. Baxter, Kinston; James C. Grant; John N. Garner, both of Kingston, all of Canada

[73] Assignee: Northern Telecom Limited, Montreal, Canada

[21] Appl. No.: 4,518

[22] Filed: Jan. 20, 1987

[51] Int. Cl.[4] ..... B05D 5/12

[52] U.S. Cl. ..... 427/118; 427/120; 427/307; 427/309; 427/377; 427/141; 427/142

[58] Field of Search ..... 427/120, 118, 307, 309, 427/377, 141, 142

[56] References Cited

U.S. PATENT DOCUMENTS

| | | | |
|---|---|---|---|
| 3,559,280 | 2/1971 | Mailhoit et al. | 427/409 |
| 4,507,362 | 3/1985 | Chapin et al. | 427/118 |
| 4,647,474 | 3/1987 | Masuda et al. | 427/118 |

*Primary Examiner*—Thurman K. Page
*Assistant Examiner*—Leon R. Horne
*Attorney, Agent, or Firm*—R. J. Austin

[57] ABSTRACT

In a method and apparatus for coloring polymer-insulated wire, the wire is guided through a solvent reservoir to dissolve surface contaminants and etch the surface of the insulation, and passed between opposed wiping surfaces to wipe surface contaminants from the wire. The wire is then passed through a hot air duct to evaporate solvent remaining on its surface. The dried wire is guided through a solvent-based colorant reservoir to coat it with colorant and passed against a wiping surface to wipe excess colorant from its surface. The coated wire is passed through a hot air duct to evaporate some of the solvent in the colorant, and through a cold air duct to harden an outer surface of the colorant before it passes over a guide wheel. The hardened surface prevents adherence of the colorant to the guide wheel. The coated wire is passed by a spraying device which intermittently sprays solvent-based colorant on the wire to band encode it. The band-encoded wire is passed through a hot air duct to evaporate some of the solvent in the bands of colorant, and through a cold air duct to form a hardened outer surface skin on the bands of colorant before they pass over a guide wheel. The hardened surface skin prevents adherence of the bands of colorant to the guide wheel. The method and apparatus are useful for reclaiming polymer-insulated wire with off-standard or undesired coloration.

8 Claims, 2 Drawing Figures

METHOD FOR COLORING POLYMER-INSULATED WIRE

The invention relates to a method and apparatus for colouring polymer-insulated wire.

Conventionally, polymer-insulated wire is colour-coded by passing it through a spraying device which sprays bands of solvent-based colourant on the wire. The wire is then passed through a duct fed by hot air blowers to evaporate the solvent and dry the colourant on the wire. It is generally necessary to redirect the colour-coded wire as it leaves the duct by passing it over a guide wheel or other guide device which contacts the outer surface of the colourant applied to the wire. If the outer surface of the colourant is still tacky when the wire passes over the guide device, the guide device may strip colourant from the surface of the wire, marring the colour-coding and coating the guide device with tacky colourant. Such problems could occur if the wire is run through the duct too quickly, so that the wire spends insufficient time in the duct to ensure that all the solvent from the colourant is evaporated. Consequently, the need to ensure that the outer surface of the colourant is not tacky when the wire passes over the guide device places a practical constraint on the speed at which the wire can be run through a conventional colouring apparatus.

The present invention provides a method and apparatus for colouring polymer-insulated wire which seeks to alleviate the above problems.

One aspect of the invention provides a method for colouring polymer-insulated wire, comprising: applying colourant comprising a solvent and a colouring agent dissolved in the solvent to a polymer-insulated wire; and passing the coloured wire first through air heated sufficiently to evaporate a portion of the solvent and then through cooled suficiently to harden an outer surface of the colourant before the coloured wire contacts any other surface.

The cooled air applied to the wire causes hardens an outer surface of the colourant. This hardened surface prevents adherence of the colourant to downstream guide devices, so that the wire can be run through the colouring apparatus at higher speeds.

Another aspect of the invention provides a method for colouring polymer-insulated wire, comprising: etching the surface of the polymer insulation and dissolving surface contaminants by passing the wire through a reservoir containing an insulation etching and contaminant dissolving solvent; removing the dissolved surface contaminants and solvent from the etched insulation surface; and applying colourant to the wire.

Surface treatment of the polymer-insulated wire prior to application of the colourant removes contaminants and etches the surface of the insulation to improve penetration and retention of the colourant.

Figure 1:
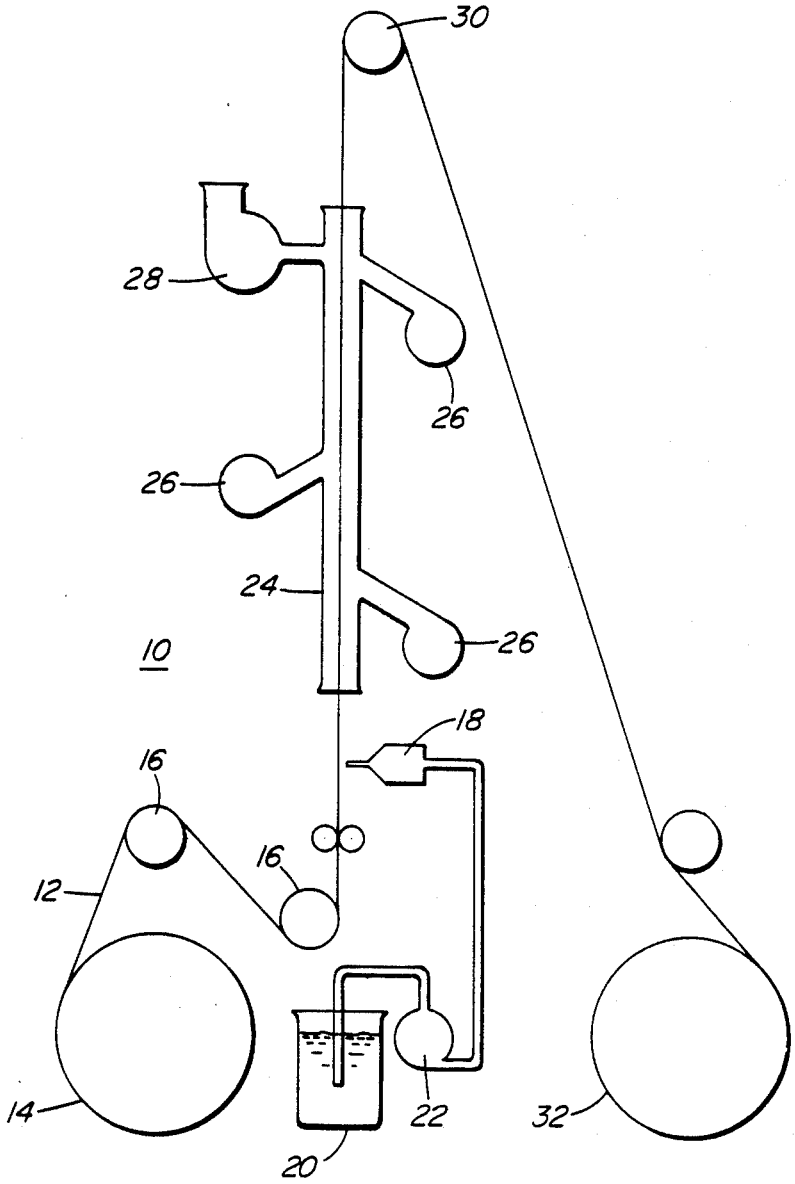
Figure 2:
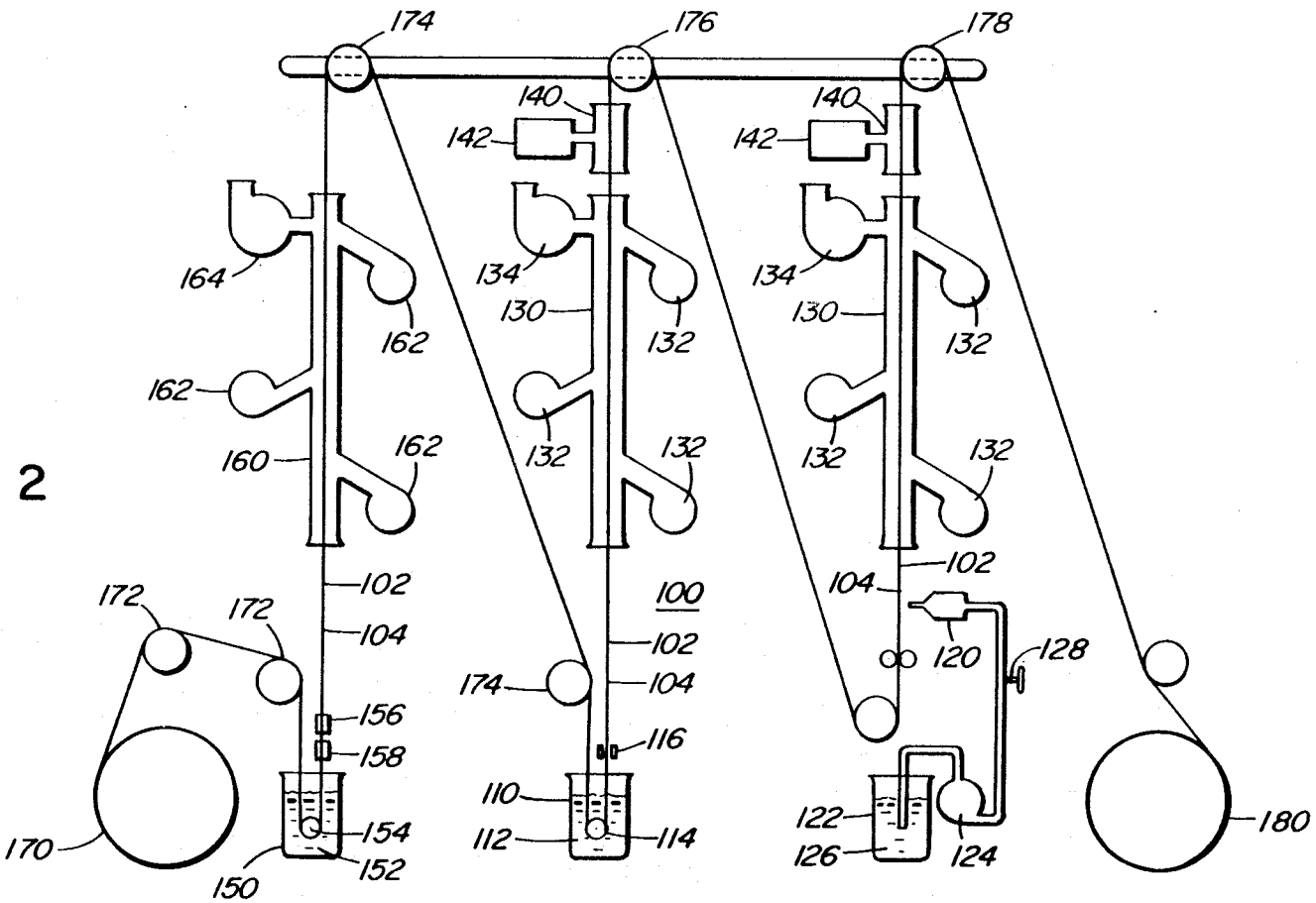

An embodiment of the invention will now be described, by way of example only, with reference to the accompanying drawings in which:

FIG. 1 is a schematic cross-sectional view of conventional apparatus for colour coding polymer-insulated wire; and FIG. 2 is a schematic cross-sectional view of apparatus according to the embodiment.

In a conventional apparatus 10 for colour coding polymer-insulated wire, polymer-insulated wire 12 is advanced from a give-up reel 14 through guide wheels

16 to a spray head 18 which intermittently sprays solvent-based colourant onto the wire so as to apply bands of colourant to the wire. The spray head 18 is fed from a colourant reservoir 20 by a pump 22. The wire 12 is advanced from the spray head 18 through a drying tube 24 fed by hot air blowers 26 which direct heated air against the wire to evaporate the solvent of the solvent-based colourant on the surface of the wire. An exhaust fan 28 draws solvent fumes out of the drying tube 24. The wire 12 is advanced from the drying tube 24 over an upper guide wheel 30 and onto a take-up reel 32.

If the wire 12 is advanced through the drying tube 24 too quickly, insufficient solvent will be evaporated during the passage of the wire through the drying tube. Consequently, colourant on the surface of the wire 12 will still be tacky when the wire passes over the upper guide wheel 30, and some of the colourant will be stripped from the wire by the upper guide wheel, thereby marring the colouration on the wire. Moreover, colourant buildup on the guide wheel 30 will interfere with its correct and efficient operation. Thus, the need to fully dry the colourant on the wire 12 as it passes through the drying tube 24 places a practical constraint on the speed at which the wire can be run through the conventional apparatus 10.

Apparatus 100 according to an embodiment of the invention for colouring polymer-insulated wire 102 as it is advanced along a passline 104 comprises means for applying solvent-based colourant to the wire as it is advanced along the passline. The apparatus 100 includes two such means, the first comprising a reservoir 110 for containing solvent-based colourant 112, guide means in the form of a guide wheel 114 rotatably supported within the reservoir for guiding the wire 102 along the passline 104 through the solvent-based colourant, and means for wiping excess colourant from the wire in the form of a die 116 supported downstream of the reservoir. This colourant applying means applies substantially uniform colouration to the wire 102.

The second such colourant-applying means comprises spraying means including a spray head 120 fed from a reservoir 122 by a pump 124 for spraying the solvent-based colourant 126 onto the wire as it is advanced along the passline 104. The spraying means also includes control means (shown schematically as a value 128) operable to interrupt the spraying of the wire 102. Periodic operation of this control means permits dot or band encoding of the wire 102.

The passline 104 is arranged so that the wire 102 moves vertically, in this case vertically upwards, as it is advanced away from each colourant applying means.

The apparatus 100 also comprises means for applying heated air to the wire 102 and means for applying cooled air to the wire as it is advanced along the passline 104 downstream from each colourant applying means. Each heated air applying means comprises a vertical heated air duct 130 surrounding and extending along a vertical portion of the passline 104 leading upwardly away from the associated colourant applying means. Each means for applying heated air further comprises means for heating air and introducing the heated air into the heated air duct 130, in the form of hot air blowers 132 communicating with the interior of the heated air duct. Exhaust means in the form of a fan 134 also communicates with the interior of each heated air duct 130 at its upper (i.e. downstream) end. The fan 134 extracts heated air and evaporated solvent from the upper end of the heated air duct 130.

Each cooled air applying means comprises a vertical cooled air duct 140 surrounding and extending along a vertical portion of the passline 104 leading upwardly away from the associated heated air duct 130. Each cooled air applying means further comprises means for cooling air and for introducing the cooled air into the cooled air duct 140 in the form of a refrigeration device 142, such as a vortex tube fed from a compressed air supply and mounted to the cooled air duct so as to direct cooled air into the duct.

It follows that each cooled air duct 140 provides a downstream portion of a duct means, and a corresponding heated air duct 130 provides an upstream portion of the duct means, with the fan 134 positioned between these two portions for extracting air and evaporated solvents from the duct means.

The apparatus 100 also comprises means for cleaning and surface treating the polymer-insulated wire located upstream of the means for applying solvent-based colourant. The means for cleaning and surface treating comprises a reservoir 150 for containing solvent 152, guide means in the form of a guide wheel 154 rotatably supported within the reservoir for guiding the wire 102 along the passline 104 through the solvent, and wiping means comprising two pairs 156, 158 of felt pads located on opposite sides of the passline downstream of the reservoir. One pair 156 of felt pads is located downstream of and oriented substantially perpendicular to the other pair 158, and each pair is provided with means (not shown) operable to separate the felt pads away from the passline 104, to permit feeding the wire 102 between the felt pads, and operable to bring the felt pads together on the passline for wiping the wire as it is advanced along the passline.

A drying means comprising a drying duct 160, hot air blowers 162 and an exhaust fan 164 arranged as described for the heated air ducts 130, hot air blowers 132 and exhaust fans 134 of the means for applying heated air is located on the passline 104 downstream of the means for cleaning the wire. It follows that the apparatus has three ducting columns, a first comprising the drying duct 160, and the second and third each comprising a heated air duct 130 and a cooled air duct 140.

Each of the ducts 130, 140, 160 opens on a vertical plane into two parts (not shown) to facilitate feeding of the wire 102 through the ducts prior to operation of the apparatus 100. Once the wire 102 has been fed through the ducts 130, 140, 160 the duct parts are closed together to enclose the wire on vertical portions of the passline during operation of the apparatus 100. The duct structure and feeding procedure is described in detail in a copending application filed herewith in the names of G. D. Baxter, J. C. Grant and J. N. Garner.

In use of the apparatus 100 to re-colour polymer-insulated wire 102 bearing flawed, incorrect or undesired colouration, the wire is advanced from a give-up reel 170 over guide wheels 172 into the solvent reservoir 150 containing a suitable solvent 152, such as methyl ethyl ketone (MEK) or methylene chloride solvents. The guide wheel 154, which is supported within the reservoir 150, guides the wire 102 through the solvent 152 to dissolve unwanted surface contaminants, such as unwanted colourant, and upward to pass between opposed wiping surfaces of the pairs 156, 158 of felt pads, which wipe dissolved surface contaminants, such as unwanted colourant, from the wire 102. The solvent also acts to etch the surface of the PVC insulation, improving its absorption and retention of the solvent-based colourant. The wire 102 is then advanced through the duct 160 of the drying means, where heated air from the hot air blowers 162 evaporates solvent from the wire, and the exhaust fan 164 draws solvent fumes from the duct, and over guide wheels 174 to the reservoir 110 of one of the means for applying colourant to the wire.

The guide wheel 114 supported in the reservoir 110 guides the wire 102 through the solvent-based colourant 112 to coat the wire with colourant of the desired background colour. The wire 102 is advanced from the reservoir 110 through the die 116 to wipe off excess colourant and into one of the heated air ducts 130 where heated air from the associated hot air blowers 132 evaporates solvent from the colourant on the wire, and the exhaust fan 134 draws heated air and entrained solvent fumes from the duct. The wire 102 is passed from the heated air duct 130 into one of the cooled air ducts 140, where cooled air is directed from the associated refrigeration device 142 onto the wire to harden an outer surface of the colourant, and over an upper guide wheel 176. The hardened surface prevents adherence of the otherwise tacky colourant to the upper guide wheel 176, even if the solvent is not fully evaporated from the colourant upon reaching the guide wheel 176.

The wire 102 is advanced from the upper guide wheel 176 to the spraying apparatus comprising spray head 120. Solvent-based colourant is sprayed intermittently on the wire using the control means 128 so as to apply encoding bands of colourant of the desired band colour. The wire 102 is advanced from the spray head 128 through one of the heated air ducts 130 to evaporate a portion of the solvent (as described above), and through one of the cooled air ducts 140 to harden an outer surface of the colourant (as described above), before it passes over an upper guide wheel 178 to a take-up reel 180. The hardened surface prevents adherence of the bands of colourant to the upper guide wheel 178 in the manner described above for the other upper guide wheel 176.

Because a hardened surface is formed on the colourant before the wire 102 is advanced over the upper guide wheels 176, 178, it is not essential that the solvent be fully evaporated from the colourant as the wire passes through the heated air ducts 130. Consequently, the wire may be advanced through the apparatus 100 according to the embodiment more quickly than it could be advanced through the conventional apparatus 10 with a comparable heated air duct length for each operation without marring the colouration of the wire.

In modifications of the embodiment, it is not essential to use all elements of the apparatus 100 together. For example, the wire 102 need not be routed through the cleaning and drying means if no cleaning or surface preparation of the wire is required, need not be routed through the colourant reservoir 110 and its associated hot air and cold air ducts 130, 140 if no background colouration is required, and need not be routed past the spray head 120 and its associated hot air and cold air ducts 130, 140 if no band encoding is required. However, surface preparation provides better colourant penetration and retention and is preferred when background colouration is applied to the insulation.

What is claimed is:

1. A method for colouring polymer-insulated wire comprising:

applying colourant comprising a solvent and a colouring agent dissolved in the solvent to a polymer-insulated wire; and passing the coloured wire first through air heated sufficiently to evaporate a portion of the solvent and then through air cooled sufficiently to harden an outer surface of the colourant before the coloured wire contacts any surface.

2. A method as defined in claim 1, comprising:

passing the coloured wire through the heated air within a duct means to evaporate said portion of the solvent and entrain it into the heated air; and passing the partially dried wire through the cooled air while in the duct means.

3. A method as defined in claim 2, comprising passing the coloured wire through the duct means in a substantially vertical direction.

4. A method as defined in claim 1, wherein the step of applying colourant to the wire comprises:

passing polymer-insulated wire through a reservoir containing colourant to coat the wire with colourant; and passing the coated wire through wiping means to wipe excess colourant from the wire.

5. A method as defined in claim 1, wherein the step of applying colourant to the wire comprises:

passing polymer-insulated wire through a space while spraying colourant into the space and onto the wire.

6. A method as defined in claim 5, wherein the colourant is sprayed intermittently so as to apply bads of colourant to the wire.

7. A method as defined in claim 1, further comprising cleaning and preparing the surface of thepolymer-insulated wire before applying colourant to it, by:

passing the wire through a reservoir containing solvent to etch the surface of the polymer insulation and dissolve surface contaminants;

passing the wire between opposed wiping surfaces to wipe off dissolved surface contaminants; and passing the wiped wire through heated air to evaporate solvent remaining on its surface.

8. A method for colouring polymer-insulated wire, comprising:

etching the surface of the polymer insulation and dissolving surface contaminants by passing the wire through a reservoir containing an insulation etching and contaminant dissolving solvent;

removing the dissolved surface contaminants and solvent from the etched insulation surface; and applying colourant comprising a solvent and a colouring agent dissolved in the solvent to a polymer-insulated wire; and passing the coloured wire first through air heated sufficiently to evaporate a portion of the solvent and then through air cooled sufficiently to harden an outer surface of the colourant before the wire contacts any surface.

* * * * *